United States Patent [19]

Knarr

[11] 3,949,994

[45] Apr. 13, 1976

[54] THREE DIMENSIONAL INTERLOCKING PUZZLES

[76] Inventor: Raymond L. Knarr, The Stone Barn Apartments, Bldg. 4, Apt. 5, Kennett Square, Pa. 19348

[22] Filed: Apr. 11, 1975

[21] Appl. No.: 567,094

[52] U.S. Cl. ..... 273/160

[51] Int. Cl.[2] ..... A63F 9/12

[58] Field of Search ..... 273/160, 156, 157 R

[56] References Cited

UNITED STATES PATENTS

| | | | |
|---|---|---|---|
| 2,181,116 | 11/1939 | Boyle | 273/156 |
| 3,523,384 | 8/1970 | Adelsohn | 273/157 R |
| 3,646,592 | 2/1972 | Bosley et al. | 273/157 R |
| 3,721,446 | 3/1973 | Young | 273/157 R |

*Primary Examiner*—Anton O. Oechsle

*Attorney, Agent, or Firm*—Zachary T. Wobensmith, 2nd; Zachary T. Wobensmith, III

[57] ABSTRACT

A puzzle is described in the form of a three dimensional body, the exterior of which is preferably a cube and composed of eight elements, having their exterior surfaces forming the body, such as a cube, the constituent parts of which do not form the exterior appear to be readily separable, the elements being in pairs diagonally and slidably separable, the pairs when in extended positions permitting complete disassembly, assembly being achieved by a reversal of the disassembly.

9 Claims, 11 Drawing Figures

THREE DIMENSIONAL INTERLOCKING PUZZLES

BACKGROUND OF THE INVENTION

1. Field of the Invention

This invention relates to a puzzle and more particularly to a take-apart and put together puzzle in three dimensional form.

2. Description of the Prior Art

It has heretofore been proposed to provide puzzles in which a solid three dimensional figure is composed of a plurality of component parts which are interlocked and which present difficulties when viewed from the exterior as to the disassembly and which, with the separated parts available, present difficulties as to the assembly.

It has also been proposed to provide puzzles involving a plurality of cubes.

Thompson, in U.S. Pat. No. 3,638,949, shows one form of composite cube puzzle but the components are not locked together.

Randolph, in U.S. Pat. No. 3,645,535, shows a plurality of parts which can, by proper arrangement, be assembled into a regular polyhedron or part thereof. The components are not held or locked together.

Steinhardt, in U.S. Pat. No. 2,625,399, shows a three dimensional take apart puzzle in which a plurality of slidably engaged interlocking parts are utilized. Different exterior shapes are shown including cubical and spherical but the structures, their assembly and disassembly bear little resemblance to the present puzzle.

SUMMARY OF THE INVENTION

In accordance with the present invention a puzzle is provided preferably but not limited to a puzzle having a cubical exterior and displaying the exterior of eight individual cube like elements, the eight individual elements having interior face portions contacting interior face portions of three adjoining exterior elements, each of the elements having a connecting extension secured thereto with a slidable bar connection to the connecting extension of a diagonally opposite exterior element, each of the exterior elements having an interior notch or cut out, the faces of which engage the connecting extensions of a connected pair of exterior elements, one of which is in another tier and one of which is the same tier and diagonally disposed with respect to it.

It is the principal object of the invention to provide a three dimensional puzzle which presents an appearance of difficulty to solve but which by proper manipulation can be readily disassembled and assembled.

It is a further object of the invention to provide a puzzle in the form of a solid figure composed as viewed from the exterior of eight smaller solid figures locked and held together in two tiers and which are difficult to separate unless the proper manipulation of the parts is employed.

It is a further object of the invention to provide a puzzle in the form of a cube which as viewed from the exterior appears to be composed of eight smaller cubes locked and held together in two tiers in a symmetrical arrangement in any orientation with one exterior face horizontally disposed.

It is a further object of the invention to provide a puzzle having a simple but effective interior locking arrangement for retaining the parts in assembled condition but permitting separation for disassembly when properly manipulated.

It is a further object of the invention to provide a puzzle the component parts of which are simple in construction, three basic parts being utilized and which can be made of wood or molded and extruded plastic.

It is a further object of the invention to provide a puzzle which is attractive in appearance and which will be interesting and instructive to the user.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
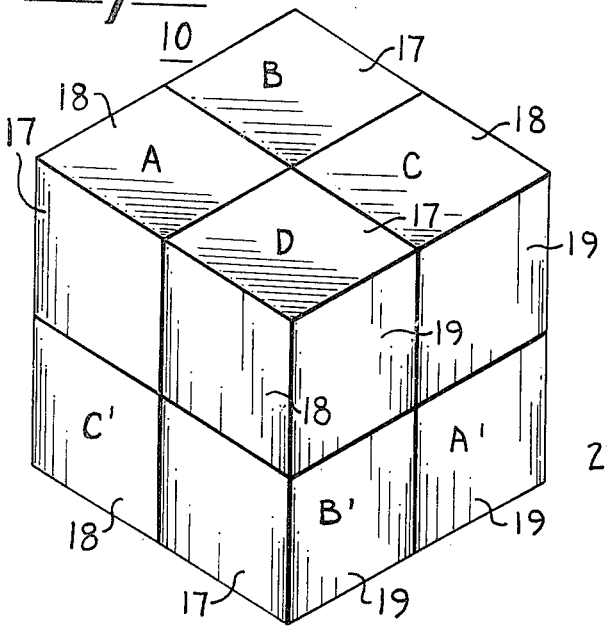
FIG. 1 is an isometric view of a puzzle in accordance with the invention as seen from the exterior.
Figure 5:
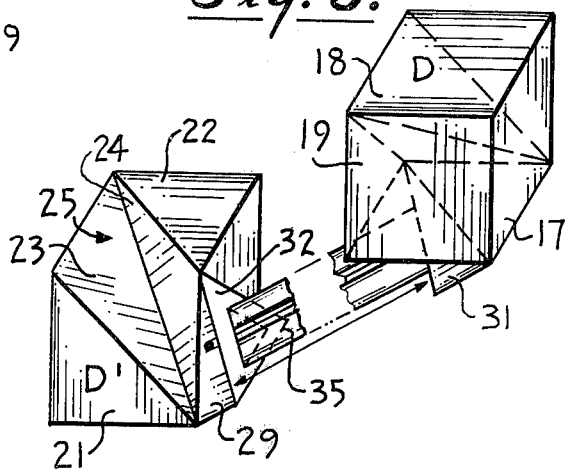
FIG. 5 is an isometric view of another pair of cubical components shown in separated relation and in the same relative positions as in FIG. 1.

Referring now more particularly to FIG. 1 of the drawings a polyhedron is there shown at 10, comprising a cube, and apparently composed as seen from the exterior, of eight smaller cubes A, B, C, D, A′, B′, C′, and D′, in two tiers.

The exterior components A and A′, B and B′, C and C′, and D and D′ are each related and diagonally interiorly interconnected pairs and interlocked with contiguous components as will more fully appear.

Figure 2:
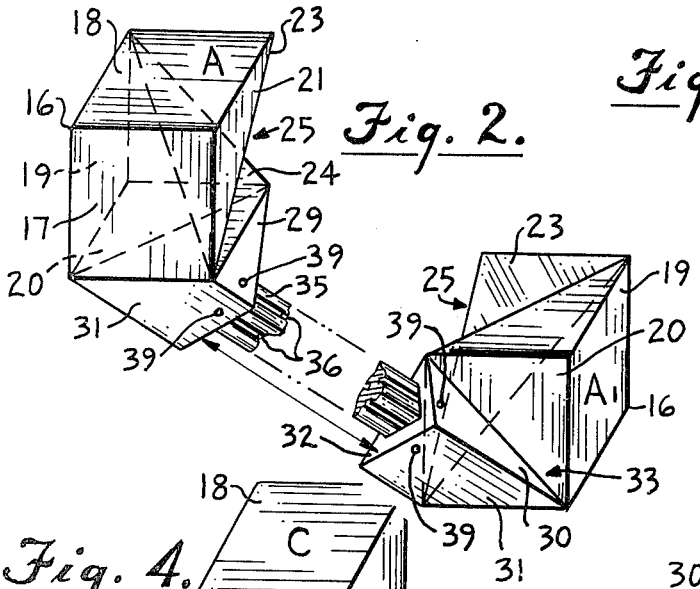
FIG. 2 is an isometric view of one pair of cubical components shown in separated relation and in the same relative positions as in FIG. 1.
Figure 3:
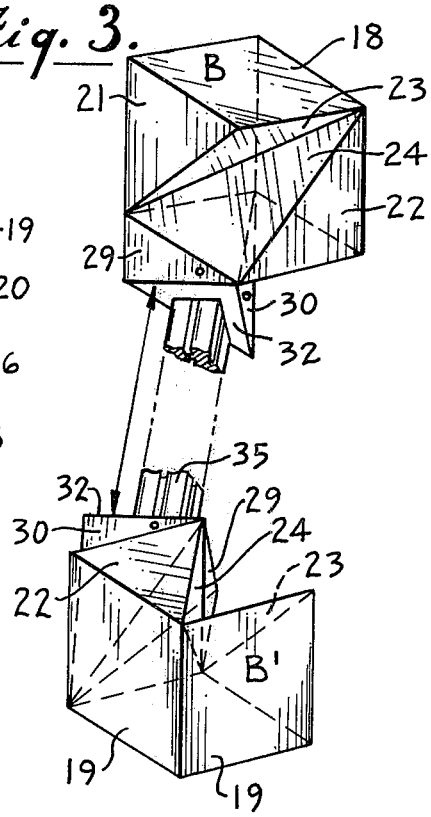
FIG. 3 is an isometric view of another pair of cubical components shown in separated relation and in the same relative positions as in FIG. 1.
Figure 4:
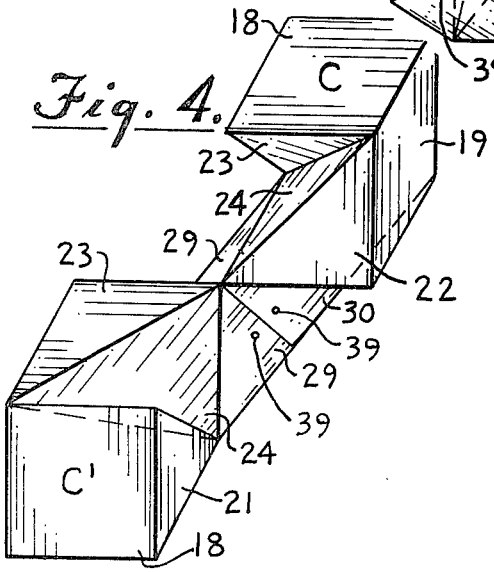
FIG. 4 is an isometric view of another pair of cubical components shown in separated relation and in the same relative positions as in FIG. 1.
Figure 6:
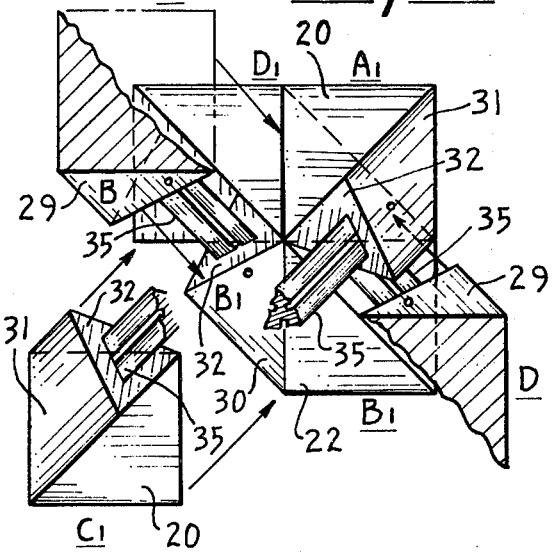
FIG. 6 is a plan view, with parts broken away of the puzzle shown in FIG. 1, but with some of the cubical components in separated relation and showing the relation of the connecting bars and the lower tier of elements.
Figure 7:
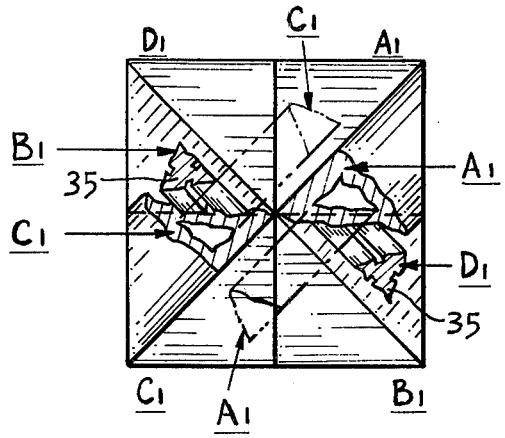
FIG. 7 is a transverse sectional view taken midway between the top and the bottom of FIG. 1 and showing the relation of the connecting bars and the lower tier of elements.
Figure 8:
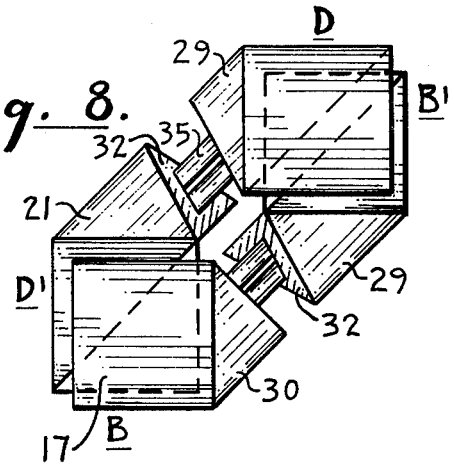
FIG. 8 is an isometric view showing the interrelationship between two pairs of cubical components in partly separated relation.
Figure 9:
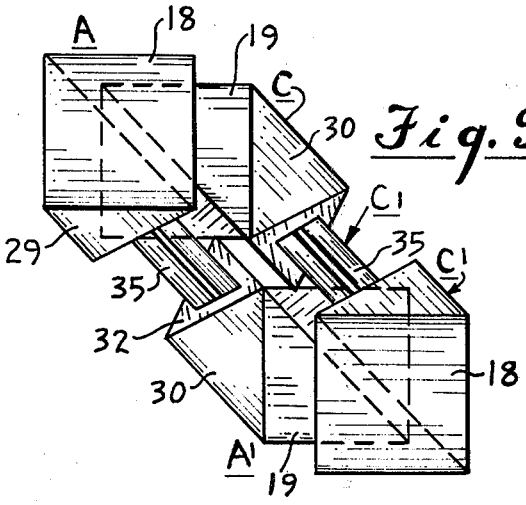
FIG. 9 is a view similar to FIG. 8 showing the interrelationship between two different pairs of cubical components in partly separated relation.
Figure 10:
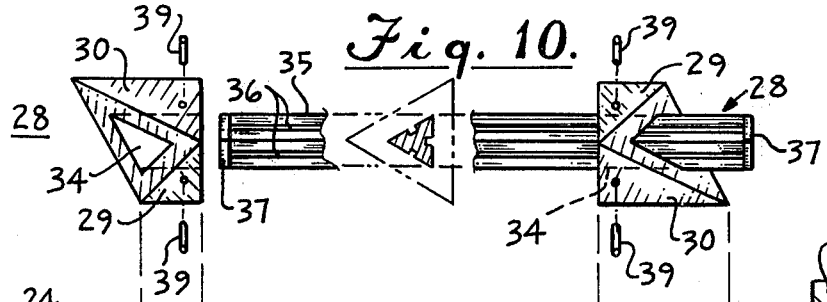
FIG. 10 is a partially exploded view showing the interior connecting and holding structure for the exteriorly disposed components.
Figure 11:
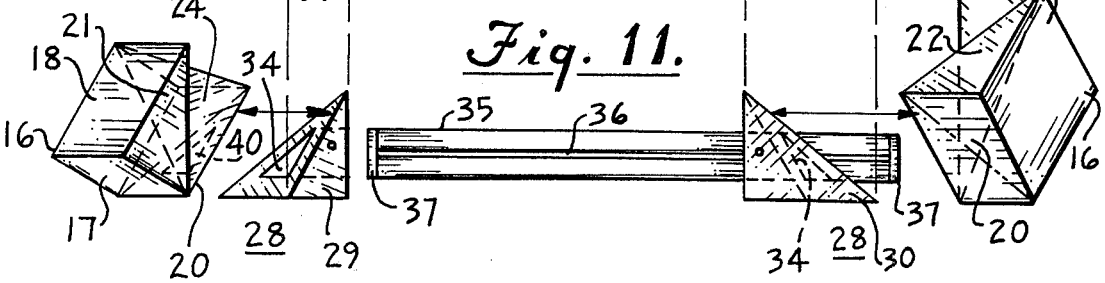
FIG. 11 is a partially exploded view showing the interior connecting and holding structure and the relation of the exterior components thereto.

Referring now more particularly to FIGS. 2, 10 and 11 for purposes of illustration the cubical elements A and A′ will be described, the other pairs being duplicates thereof although differently disposed as indicated in FIG. 1.

The exterior element A, for a cubical exterior has an apex 16 from which three square exterior faces 17, 18 and 19 extend, disposed in three perpendicular axial planes and presenting the appearance of the exterior of a small cube.

The element A has a face 20 parallel to the face 18, a triangular face 21 parallel to the face 19 and connecting meeting marginal edges of the faces 17 and 18, and a triangular face 22 parallel to the face 17 and connecting meeting marginal edges of the faces 19 and 20. An interior face 23 triangular in shape connects meeting marginal edges of the faces 18 and 21 and extends to an interior diagonal of the cubical element A spaced from the apex 16. An interior face 24 triangular in shape connects meeting marginal edges of the faces 22 and 23 and extends to the same interior diagonal of the cubical element A to which the face 23 extends. A wedge shaped notch 25 triangular in transverse cross section is thus provided to assist in the locking action hereinafter referred to.

A connecting extension 28 is provided secured to a part of the face 20 and extending therefrom with a face 29 formed as an extension of the face 24, a face 30 perpendicular to the face 20 and an exteriorly angularly disposed face 31. The faces 29, 30 and 31 terminate at an end abutment face 32 and the face 20 with the face 30 provides a wedge shaped notch 33 triangular in transverse cross section.

The connecting extension 28 has an opening 34 extending inwardly from the abutment face 32 for slidable movement therein of a connecting bar 35 of complemental cross section. The bar 35 as shown is triangular to prevent turning of the cubical elements A and A′ with respect to each other.

The bar 35 is shown as having grooves 36 therealong with end plates 37 closing the ends of the grooves 36. Pins 39 in the extension 28 and extending into the grooves 36 prevent separation of the cubical elements A and A′ upon engagement of the pins 39 with the end plate 37. The cubical elements A and A′ can each have a portion 40 removed, inwardly of the face 20 to provide clearance for the end of the bar 35 in assembled condition.

The shape and size of the element A′ is like that of element A, is similarly slidably held with respect to the bar 35 but is differently oriented on the connector bar 35 from the element A.

Each of the units B—B′, C—C′ and D—D′ is identical to unit A—A′, previously described. The units, for purposes of assembly, are preferably also oriented with their exposed faces as illustrated in FIG. 1, so that the two notches 25 and 33 are engaged with the faces of other connecting extensions 28 and other faces, the connecting extension 28 for each unit being disposed in parallel pairs and diagonally.

With this arrangement and because of the disposition of the respective notches 25 and 33 in their relation to the block elements, a notch 25 of one block engages the connectors 28 of a diagonally opposite block unit and either the connectors 28 of a block unit clockwise in advance or the connectors 28 of a block unit counterclockwise the notch 33 being similarly engaged with a notch 33 of a contiguous block element.

It will be noted that for the slidably connected block unit comprising the elements A and A′, and in assembled condition the notch 25 of element A engages the exterior faces 30 and 31 of the connectors 28 of units B and B′ and the notch 25 of the element A′ engages the exterior faces 30 and 31 of the connectors 28 of elements C and C′.

For the block unit comprising the slidably connected elements B and B′, the notch 25 of element B engages the faces 30 and 31 of elements D and D′ while the notch 25 of B′ engages the faces 30 and 31 of elements A and A′.

For the block unit comprising the slidably connected elements C and C′ the notch 25 of element C engages the exterior faces 30 and 31 of the connectors 28 of D and D′ and the notch 25 of element C′ engages the faces 30 and 31 of connectors 28 of elements A and A′.

For the block unit comprising the slidably connected elements D and D′ the notch 25 of the element D engages the faces 30 and 31 of the elements B and B′ while the notch 25 of element D′ engages the faces 30 and 31 of elements C and C′.

For the block unit comprising the slidably connected elements A and A′ the notch 33 of element A engages the faces 22 and 24 of element C′ and the notch 33 of element A′ engages the faces 22 and 24 of the element B′.

For the block unit comprising the slidably connected elements B and B′ the notch 33 of element B engages the faces 24 and 22 of element A and the notch 33 of element B′ engages the faces 22 and 24 of the element D.

For the block unit comprising the slidably connected elements C and C′ the notch 33 of element C engages the faces 22 and 24 of element A′ and the notch 33 of element C′ engages the faces 22 and 24 of the element D′.

For the block unit comprising the slidably connected elements D and D′ the notch 33 of element D engages the faces 22 and 24 of element C and the notch 33 of element D′ engages the faces 22 and 24 of element B.

In order to disassemble the cube each of the elements A, B, C and D of the upper tier is moved upwardly and outwardly as permitted by the slidable mounting thereof with respect to the elements A′, B′, C′ and D′ of the lower tier. The four units may then be separated from each other for complete disassembly.

In order to assemble the puzzle the units are first extended and the elements arranged in the order shown in FIG. 1 and then the elements of each unit are forced together and the cube will then be obtained.

It will thus be seen that a puzzle has been provided with which the objects of the invention are attained.

I claim:

1. A puzzle comprising a body of three dimensions with diagonally related surface portions, said surface portions being constituted by a plurality of elements, said portions being arrayed relative to each other so as to form two vertically arrayed tiers thereof, pairs of said elements each comprising a discrete unit having a slidable connection therebetween for movement of elements in each pair away from each other to enable disassembly of the units and toward each other, one of the elements of each pair being disposed in a first tier and the other element of each pair being disposed in another tier, and said slidable connections extending generally parallel to the body diagonals of said body.

2. A puzzle as defined in claim 1 in which the exterior surfaces of each element comprise exterior surface portions of a cube.

3. A puzzle as defined in claim 1 in which said body is composed of four of said units.

4. A puzzle as defined in claim 1 in which each of said elements has a notch in engagement with the slidable connection of a contiguous element.

5. A puzzle as defined in claim 1 in which each of said elements has a notch with its faces in engagement with the faces of a contiguous element.

6. A puzzle as defined in claim 5 in which each of said notches comprises a surface portion of said element and a face portion of its slidable connection.

7. A puzzle as defined in claim 1 in which said slidable connections each include a slide bar and members for limiting the separation of said elements on said slide bar.

8. A puzzle as defined in claim 1 in which said slidable connections each include a slide bar and said bar and said elements have portions permitting sliding movement of said elements on said bar while preventing relative turning movement of said elements with respect to said bar.

9. A puzzle as defined in claim 1 in which each of said slidable connections is angularly disposed with respect to contiguous slidable connections of other units.

* * * * *